US008944583B2

(12) United States Patent
Waschnig

(10) Patent No.: US 8,944,583 B2
(45) Date of Patent: Feb. 3, 2015

(54) INK JET PRINTER AND PRINTING METHOD FOR PRINTING AN IMAGE HAVING MATT AND GLOSSY IMAGE AREAS

(71) Applicant: Durst Phototechnik Digital Technology GmbH, Lienz (AT)

(72) Inventor: Christian Waschnig, Gaimberg (AT)

(73) Assignee: Durst Phototechnik Digital Technology GmbH, Lienz (AT)

( * ) Notice: Subject to any disclaimer, the term of this patent is extended or adjusted under 35 U.S.C. 154(b) by 0 days.

(21) Appl. No.: 14/344,977

(22) PCT Filed: Oct. 17, 2012

(86) PCT No.: PCT/AT2012/050165

§ 371 (c)(1),
(2) Date: Mar. 14, 2014

(87) PCT Pub. No.: WO2013/056292

PCT Pub. Date: Apr. 25, 2013

(65) Prior Publication Data

US 2014/0340456 A1 Nov. 20, 2014

(30) Foreign Application Priority Data

Oct. 19, 2011 (AT) ..... A 1530/2011

(51) Int. Cl.
*B41J 2/01* (2006.01)
*B41J 11/00* (2006.01)

(52) U.S. Cl.
CPC ..... *B41J 11/0015* (2013.01)
USPC ..... 347/102

(58) Field of Classification Search
CPC ..... C09D 11/30; C09D 11/322; C09D 11/38; B41J 2/01; B41J 2/17503; B41J 11/0015; B41J 11/002; B41J 11/007; B41J 29/17; B41J 29/377
See application file for complete search history.

(56) References Cited

U.S. PATENT DOCUMENTS

| | | | | |
|---|---|---|---|---|
| 8,424,993 | B2 * | 4/2013 | Ikehata et al. | 347/16 |
| 2009/0225143 | A1 | 9/2009 | Fukui | |
| 2010/0247795 | A1 | 9/2010 | Heath | |

FOREIGN PATENT DOCUMENTS

| | | | |
|---|---|---|---|
| GB | 2470067 | A | 11/2010 |
| WO | 2010/111121 | A1 | 9/2010 |

OTHER PUBLICATIONS

International Search Report of PCT/AT2012/050165, mailed Mar. 4, 2013.

* cited by examiner

*Primary Examiner* — Lisa M Solomon
(74) *Attorney, Agent, or Firm* — Collard & Roe, P.C.

(57) ABSTRACT

A method of printing an image (1) having matt areas (2) and glossy areas (3) is specified, whereby an ink is applied with the aid of the ink jet printing method to the matt areas (2) and cured immediately afterwards. In the glossy areas (3), on the other hand, curing of the ink immediately after applying it is omitted. Also specified are an ink jet printer (40 . . . 44) for implementing said method and a control system (11) therefor.

18 Claims, 5 Drawing Sheets

INK JET PRINTER AND PRINTING METHOD FOR PRINTING AN IMAGE HAVING MATT AND GLOSSY IMAGE AREAS

CROSS REFERENCE TO RELATED APPLICATIONS

This application is the National Stage of PCT/AT2012/050165 filed on Oct. 17, 2012, which claims priority under 35 U.S.C. §119 of Austrian Application No. A 1530/2011 filed on Oct. 19, 2011, the disclosure of which is incorporated by reference. The international application under PCT article 21(2) was not published in English.

The Invention relates to a method of printing an image having matt areas and glossy areas. The invention further relates to a control system for an ink jet printer for printing an image having matt areas and glossy areas and an ink jet printer with such a control system.

An ink jet printer and a printing method for printing an image having matt and glossy areas are known in principle. In this connection, an ink provided for the matt image areas and another ink provided for the glossy image areas are stored in two different tanks and are also applied by two different print heads. The disadvantage of the known printer and the known printing method is the need to provide two tanks and two print heads for different inks.

GB 2470067 A also discloses an ink jet printer and a printing method for printing an image having matt and glossy areas, whereby the glossy areas are exposed to less UV radiation than the matt areas during curing.

The objective of the invention is to propose an improved printing method, an improved control system for an ink jet printer and an improved ink jet printer. In particular, the intention is to avoid the need for two tanks and two print heads for different inks and a control system that is required to output differing strengths of UV radiation.

The objective of the invention is achieved by a method of the type outlined above, comprising the following steps:

- in a first pass, applying an ink with the aid of an ink jet printer having a print head and a curing device to the glossy areas of a first line without curing the glossy areas of the first line immediately afterwards and
- in a second pass, applying an ink with the aid of the ink jet printer to the matt areas of the first line and curing the matt areas of the first line immediately afterwards, and
- the curing device passes over and cures the glossy areas of the first line during the second pass.

The objective of the invention is also achieved by a method of the type outlined above, comprising the following steps:

- applying an ink with the aid of an ink jet printer having a print head and a curing device to the matt areas of a first line and curing the matt areas of the first line immediately afterwards,
- applying an ink with the aid of the ink jet printer to the glossy areas of the first line without curing the glossy areas of the first line immediately afterwards and
- applying an ink with the aid of the ink jet printer in the matt areas of a second line following the first line and curing the matt areas of the second line immediately afterwards, and
- the glossy areas of the first line are cured at the same time as the matt areas of the second line are being cured.

The objective is also achieved by means of a control system of the type outlined above, comprising an output for a curing device which is activated in the matt areas and deactivated in the glossy areas during operation of the ink jet printer, and the control system is also configured to activate the curing device so that the glossy areas are cured at the same time as the matt areas are being cured.

Finally, the objective of the invention is also achieved by an ink jet printer having a print head for ink as well as a curing device which is connected to the aforementioned control system.

As a result, an image with matt and glossy areas can be printed without having to provide two tanks and two print heads for different inks for this purpose. The difference is that the ink applied in the matt areas is cured immediately after having been applied. This pre vents the ink from being able to coalesce. The ink therefore forms a relatively rough surface, as a result of which the image areas treated in this manner appear matt. In the glossy image areas, on the other hand, the applied ink is not cured until later, which means that the ink has sufficient time to coalesce and form a smooth surface. These image areas therefore appear glossy. Accordingly, only one type of ink is needed for the glossy and matt image areas as a result of the proposed method. In the case of color printing, therefore, only one ink is needed for each color. Furthermore, a control system for activating UV radiation of differing intensities such as used in GB 2470067 A can be dispensed with because although ink is applied to matt and glossy areas at different times, curing takes place simultaneously and at the same radiation power. The proposed ink jet printer is therefore based on a particularly simple design.

Furthermore, less energy is also needed to operate the proposed printer than is the case with the printer known from GB 2470067 A. The reason for this is that the matt and glossy areas are cured in one pass using the proposed method. This being the case, the curing device only has to be activated every second pass over a line and is therefore used synergetically.

Another advantage of the proposed printer is that the glossy image areas are also completely cured because the gloss effect is obtained due to the fact that the ink is given more time to coalesce rather than the glossy areas merely being exposed to a reduced radiation power and thus not being fully cured, as is the case in GB 2470067 A. The prints produced using the method proposed by the invention are therefore extremely resistant.

Also of advantage is the fact that a line feed takes place when the matt areas and the glossy areas of a line are being printed. Based on this variant, therefore, printing of a line is finished before a line feed takes place. This being the case, the substrate has to be moved under the print head or the print head moved above the substrate in only one direction. The print is therefore particularly accurate.

Overall, it may be said that the printer proposed by the invention can be manufactured more cheaply on the one hand but is nevertheless more robust, consumes less energy and produces prints which are resistant, including in the glossy image areas.

At this stage, it should be pointed out that within the context of the invention, the term "image" should be understood as meaning a photograph in particular, as well as a graphic image with and without text. The term "image" should also be understood as meaning pure text. In this respect, for the purpose of the invention, it is irrelevant in what format the image to be printed is transmitted to the printer. For example, a text may be transmitted in ASCI format or alternatively in pixel format. Similarly, a graphic image may be transmitted in vector format or also in pixel format.

Advantageous embodiments and features of the invention are defined in the dependent claims and in the description of the drawings.

It is of advantage if the curing device is moved after the print head. This enables curing of precisely the areas which have just been applied.

It is of advantage if the matt areas are printed in one direction of movement of the print head and the glossy areas are printed in the other direction of movement of the print head. This means that a curing device has to be provided on one side of the print head only. The design of such an ink jet printer is therefore relatively compact.

It is of advantage if curing is effected be means of a UV lamp. Accordingly, the ink can be cured using simple and also technically proven means. The ink jet printer is therefore easy to use in practical terms and is also very reliable at the same time.

In this connection, it is of advantage if curing is effected by activating the UV lamp. Accordingly, the curing device of the ink jet printer in this case is a UV lamp, and the curing device is activated by switching the UV lamp on. In the matt areas, the UV lamp is therefore switched on but is switched of in the glossy areas.

Alternatively, based on one advantageous variant, it would also be conceivable for curing to be effected by opening a diaphragm mounted downstream of the UV lamp in the radiation direction. This being the case, the curing device of the ink jet printer is provided in the form of a UV lamp with a diaphragm connected downstream in the radiation direction, and the curing device is activated by opening the diaphragm. With this variant, the UV lamp may remain permanently switched on. In the matt areas, said diaphragm is opened so that the UV light hits the applied ink, and in the glossy areas it remains closed so that the UV light is prevented from reaching the applied ink.

It is also of advantage if curing takes place by means of a curing medium which is sprayed on or applied as part of the ink jet printing operation by the ink jet printer. Accordingly, the curing device of the ink jet printer is provided in the form of a print head or spray head for a curing medium, and the curing device is activated by applying the curing medium. Curing medium is therefore applied to the matt areas but not to the glossy areas. To this end, the ink used is one whose drying process can be accelerated by a curing medium. The curing medium may then be applied by means of a print head of the same design as the print head for the ink. Alternatively, the curing medium may also be applied by means of a spray head of a simpler design than the print head, which is able to spray the matt areas selectively, although this area must be larger than a print dot. Alternatively, it would also be conceivable to apply a substance which delays curing of the ink. In the same way as explained above, this substance is applied to the glossy areas but not to the matt areas.

It is of particular advantage if a distance between the print head (for ink) and the curing device can be varied. Varying the distance between the print head and curing device in terms of timing or location enables the degree of gloss of the matt image areas to be controlled. If the distance between the print head and curing device is long or large, the ink has more time to coalesce and thus forms a relatively smooth surface. These areas therefore appear to be not totally matt but also not totally glossy but tend towards glossy. If the distance between the print head and the curing device is relatively short or small, the ink has less time to coalesce and therefore forms a relatively rough surface. These areas therefore likewise do not appear totally matt and do not appear totally glossy but tend towards matt.

It is also of particular advantage if a displacement speed of the print head (for ink) and the curing device can be varied. This offers another possible way of controlling the degree of gloss of the applied ink. As a result, the ink again has more or less time to coalesce. It would also be conceivable to vary both a distance between the print head and curing device and their displacement speed as a way of covering a particularly broad range of the degree of gloss in the image areas.

It is of advantage if the curing device is disposed adjacent to the print head for ink in a direction of movement of the print head and they can be moved by a common drive for the curing device and print head. In this manner, the print head and curing device are always moved synchronously. Since only one drive is needed for the movement of both, the ink jet printer can be built to a particularly compact design.

It is also of advantage if the curing device can be coupled with the print head for ink and they can be moved by a common drive for the curing device and print head. Instead of the print head and curing device being fixedly connected to one another, the curing device may be coupled with the print head by a coupling as and when necessary. It is of advantage if the curing device is uncoupled when it is printing glossy images only, which means that only lower masses have to be moved. The print-out can be obtained correspondingly faster and the mechanisms of the printer are subjected to less stress. In particular, the coupling may be designed so that the curing device can be coupled with the print head at a differing distance. For example, the print head may be provided with a strip having a row of holes for this purpose, the latter being at a different distance from the print head and in which a pin of the curing device locates. The strip could naturally also be mounted on the curing device, in which case a pin of the print head locates in one of said holes. It would also be conceivable, for example, for the distance between the print head and curing device to be varied with the aid of a threaded spindle.

Finally, it is of advantage if the curing device and the print head for ink can be moved by separate drives. This obviates the need for a coupling between the print head and curing device. Furthermore, a distance between the print head and curing device can be varied particularly efficiently with a view to controlling the degree of gloss of the applied ink on the basis of this variant.

At this stage, it should be pointed out that the described variants of the method and the resultant advantages can literally be applied to the control system of the ink jet printer and the ink jet printer and vice versa.

To provide a clearer understanding, the invention will be described in more detail below with reference to the appended drawings.

Figure 4A:
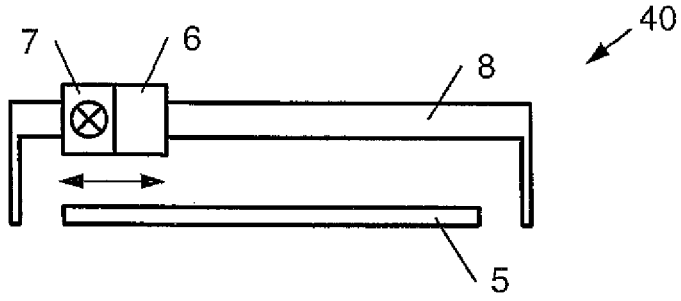
Figure 4B:
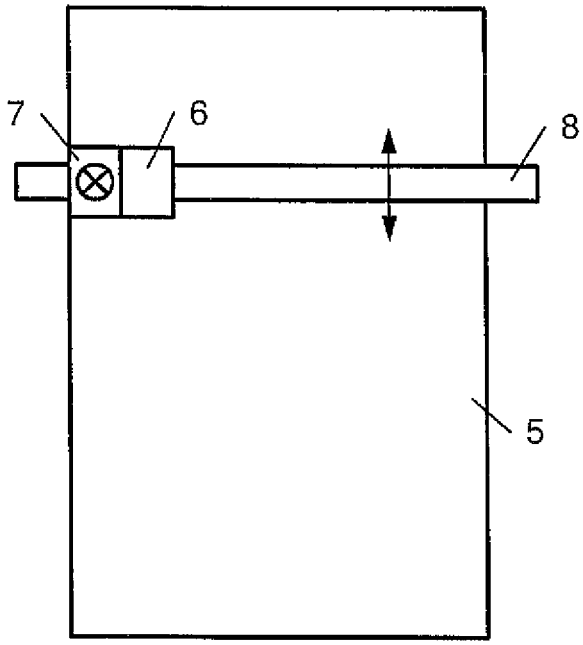
Figure 5:
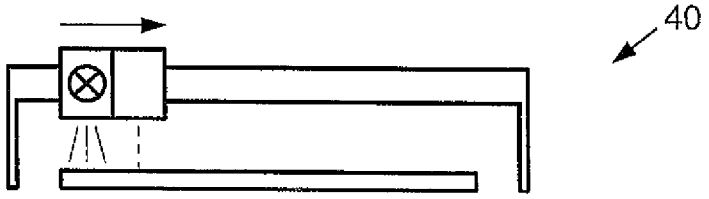
Figure 6:
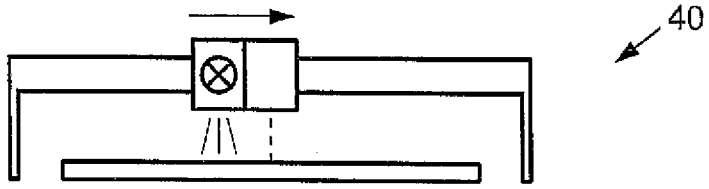
Figure 7:
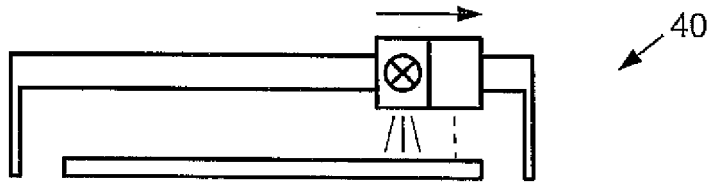
Figure 8:
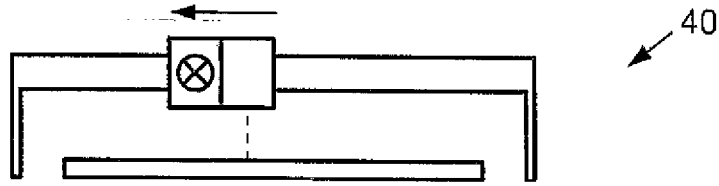
Figure 9:
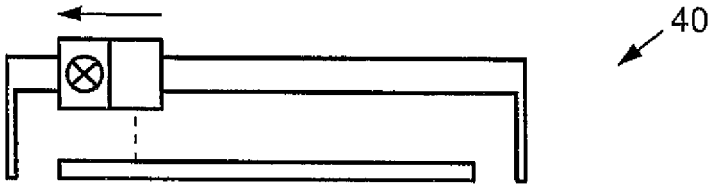
Figure 10:
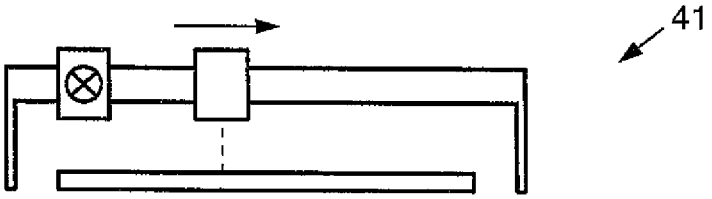
Figure 11:
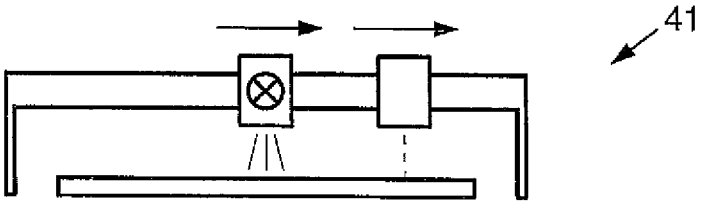
Figure 12:
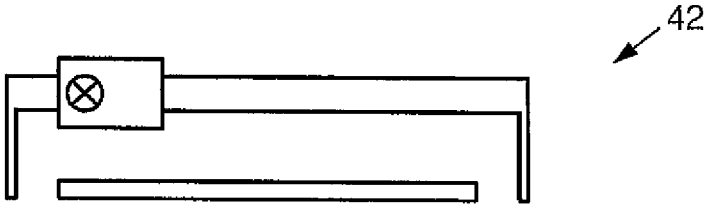
Figure 13:
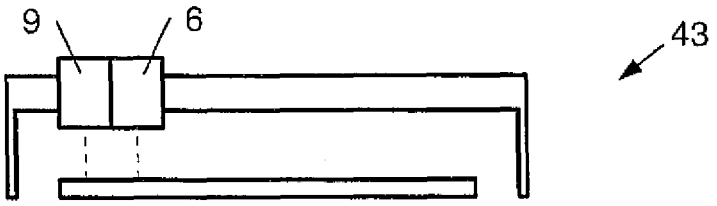
Figure 14:
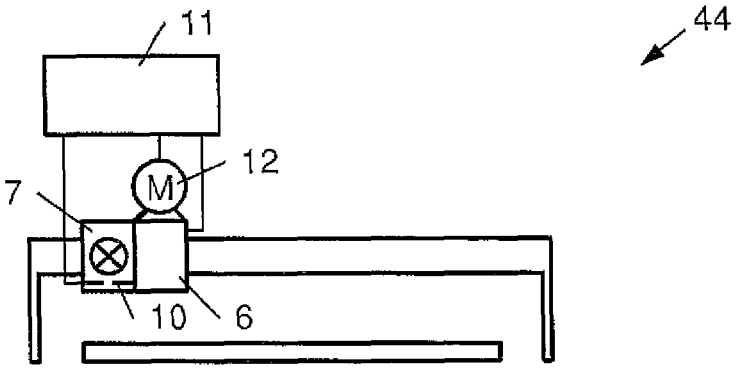

FIG. 4*a*, 4*b* show an exemplary, schematic view in elevation (FIG. 4*b*) and a plan view (FIG. 4*a*) of an ink jet printer;

FIG. 5 shows the printer illustrated in FIG. 4 in a first operating mode in which the matt image areas are being printed;

FIG. 6 is the same as FIG. 5 but showing a different position of the print head and curing device;

FIG. 7 is the same as FIG. 5 but showing the print head and curing device at the right-hand edge of the substrate;

FIG. 8 shows the printer illustrated in FIG. 4 in a second operating mode in which the glossy image areas are being printed;

FIG. 9 is the same as FIG. 8 but showing the print head and curing device at the left-hand edge of the substrate;

FIG. 10 illustrates a printer where the curing device is parked and the print head is able to move alone;

FIG. 11 illustrates a printer where the curing device and print head are able to move independently of one another;

FIG. 12 illustrates a printer where the curing device and print head constitute a component unit;

FIG. 13 illustrates a printer where the curing device is provided in the form of a print head or spray head for a curing medium and FIG. 14 illustrates an exemplary ink jet printer with a diaphragm for a UV lamp and an explicitly illustrated control system.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

All the figures relating to ranges of values in the description should be construed as meaning that they include any and all part-ranges, in which case, for example, the range of 1 to 10 should be understood as including all part-ranges starting from the lower limit of 1 to the upper limit of 10, i.e. all part-ranges starting with a lower limit of 1 or more and ending with an upper limit of 10 or less, e.g. 1 to 1.7, or 3.2 to 8.1 or 5.5 to 10.

Figure 1:
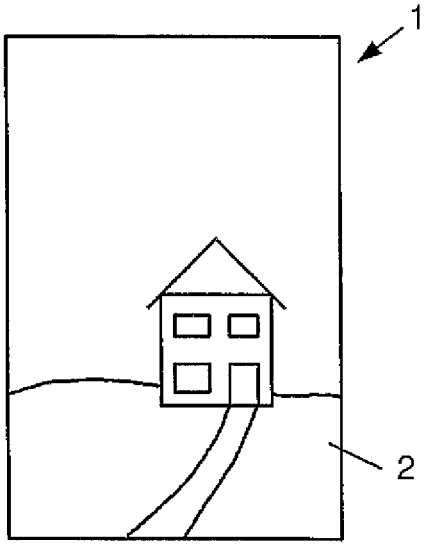
FIG. 1 illustrates the matt image areas of an exemplary image.
Figure 2:
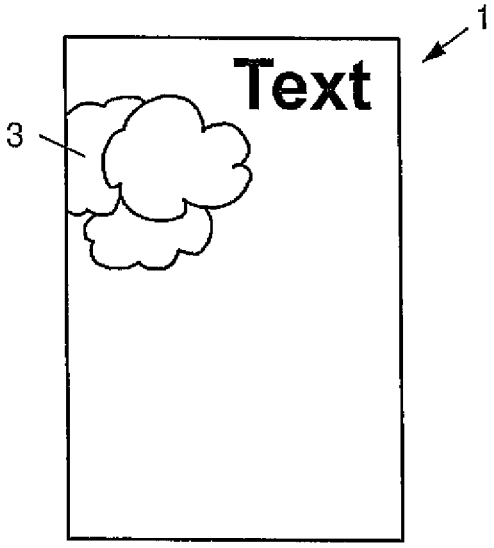
FIG. 2 illustrates the glossy image areas of the image illustrated in FIG. 1.
Figure 3:
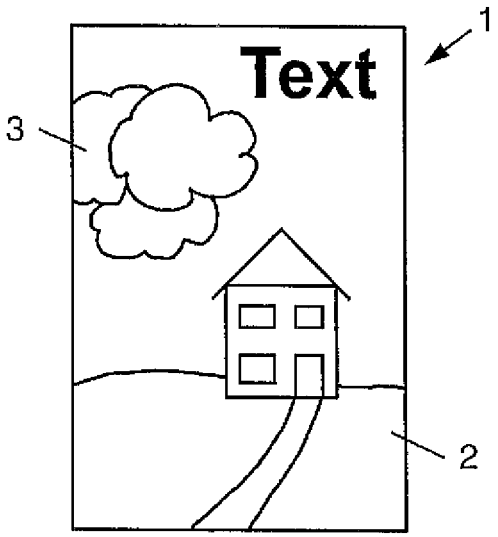
FIG. 3 illustrates the complete image made up of those partially illustrated in FIGS. 1 and 2.

FIGS. 1 to 3 illustrate an example of an image 1 with matt areas 2 and glossy areas 3. In FIG. 1, only the matt areas 2 of the image 1 are illustrated, specifically a house and the landscape in the foreground. FIG. 2 illustrates only the glossy areas 3 of the image 2, specifically the clouds and an exemplary text. FIG. 3, finally, illustrates the complete image 2.

FIG. 4 shows an exemplary and purely schematically illustrated ink jet printer 40 in a view in elevation (FIG. 4*b*) and a plan view (FIG. 4*a*). Disposed above a substrate 5, for example a sheet of paper, are the print head 6 for ink and a curing device 7 provided in the form of a UV lamp in this example. The print head 6 and curing device 7 are mounted so as to be displaceable on a bridge 8. The latter enables them to be pushed or moved transversely to the substrate 5 (in other words, horizontally relative to the plane of the drawing in FIG. 4). The bridge 8 itself is displaceable in a longitudinal direction of the substrate 5 (in other words, in a vertical direction relative to the plane of the drawing in FIG. 4). Accordingly, the print head 6 and curing device 7 can be moved or displaced longitudinally and transversely relative to the substrate 5.

Employing a method of printing an image 1 having matt areas 2 and glossy areas 3, the following steps are now implemented:

- an ink is applied with the aid of an ink jet printing method to the matt areas 2 and the matt areas 2 are cured immediately afterwards,
- an ink is applied with the aid of the ink jet printing method to the glossy areas 3 without curing the glossy areas 3 immediately afterwards, in particular by deactivating curing for the glossy areas 3.

For example, the print head 6 may be followed by the curing device 7, and the curing device 7 is activated in the matt areas 2 and deactivated in the glossy areas 3. The matt areas 2 are preferably printed in one direction of movement of the print head 6 and the glossy areas 3 in the other direction of movement of the print head 6. FIGS. 5 to 9 illustrate an example of a motion sequence of the ink jet printer 40, where the matt areas 2 are printed from left to right and the glossy areas are printed from right to left. The choice of direction should be seen as an example and, naturally, it would also be possible to print the matt areas 2 from right to left and the glossy areas from left to right.

In FIG. 5, the print head 6 starts up the curing device 7 at the left-hand edge of the substrate 5. As this happens, ink is applied in accordance with the ink jet printing method in a manner known per se. In addition, the UV lamp serving as the curing device 7 is activated. Due to the synchronous movement of the print head 6 and UV lamp 7, the ink that has just been applied is cured by the UV lamp 7. Since the ink is not given sufficient time to coalesce and thus form a smooth surface, these image areas 2 appear matt.

FIG. 6 illustrates the ink jet printer 40 at a later point in time. The UV lamp 7 has already passed over and therefore cured the image areas at the left-hand edge of the substrate 5.

FIG. 7 illustrates the ink jet printer 40 at an even later point in time, at which the print head 6 and curing device 7 have reached the right-hand edge of the substrate 5. Consequently, the direction of movement of the print head 6 and curing device 7 has been reversed in order to print the glossy areas 3. As this movement is reversed, the UV lamp 7 is deactivated. The ink is therefore not cured immediately after having been applied and is able to coalesce and form an essentially smooth surface. These image areas 3 therefore appear glossy.

FIG. 8 illustrates the ink jet printer 40 at a later point in time, at which the print head 6 and curing device 7 have reached more or less the middle of the substrate 5. FIG. 9 shows the ink jet printer 40 at an even later point in time, at which the print head 6 and curing device 7 have reached the left-hand edge of the substrate 5. The bridge 8 is then moved by one line in the longitudinal direction of the substrate 5 and the sequence illustrated in FIGS. 5 to 9 starts again. This sequence is repeated until the complete image 1 has been printed.

During the sequence illustrated in FIGS. 5 to 9, it would also be conceivable for the LTV lamp 7 to remain switched on during the entire printing operation—i.e. including whilst the glossy image areas 3 are being printed—if the area illuminated by the UV lamp 7 is so small that the printing area is not or is only negligibly affected by it. The fact that the UV lamp 7 precedes the print head 6 whilst printing the glossy image areas 2 means that the ink has sufficient time to coalesce even if the UV lamp 7 is activated.

At this stage, it should be pointed out that the curing device 7 need not necessarily be based on a moving design. Instead, it may also be fixedly mounted in the ink jet printer 40 and illuminate an area corresponding to at least one printed line. In this case, the curing device 7 (namely the UV lamp 7 in this specific example) is only activated when the matt image areas 2 are being printed but is deactivated when the glossy image areas 3 are being printed.

In one advantageous embodiment, the curing device 7 not only influences the line currently being printed but also the one printed before the last line feed. In this manner, the glossy image areas 3 of the last line are also cured at the same time as the matt image areas 2 of the line currently being printed are cured. Accordingly, the glossy image areas 3 are also cured but are so significantly later than the matt image areas 2.

The proposed method for printing the image 1 having matt areas 2 and glossy areas 3 therefore comprises the following steps:

applying an ink with the aid of the ink jet printer (comprising print head 6 and UV lamp 7) to the matt areas 2 of a first line and curing the matt areas 2 of the first line immediately afterwards, applying an ink with the aid of the ink jet printer to the glossy areas 3 of the first line but without curing the glossy areas 3 of the first line immediately afterwards and applying an ink with the aid of the ink jet printer to the matt areas 2 of a second line immediately following the first line and curing the matt areas 2 of the second line immediately afterwards, and the glossy areas 3 of the first line are cured at the same time as the matt areas of the second line are being cured.

It would naturally also be possible for the matt image areas 2 and the glossy image areas 3 to be set up in a direction of movement of the print head 6 and curing device 7. This being the case, the matt image areas 2 are printed during a first pass, for example, the print head 6 and curing device 7 are then moved into the initial position and the glossy image areas 3 are printed during a second pass. This is then followed by a line feed. This is of advantage if the glossy image areas 3 are printed first of all and then the matt image areas 2 are printed. During a first pass, the glossy image areas 3 are printed—for example from left to right—with the curing device 7 deactivated. During a second pass, the matt image areas 2 are printed—likewise from left to right—with the curing device 7 activated. As a result, the curing device 7 also passes over the glossy image areas 3 and therefore cures them but significantly later than the matt image areas 2. In this case, the curing device 7 does not have to influence the last printed line (namely, the one before the last line feed).

The proposed method of printing the image 1 having matt areas 2 and glossy areas 3 therefore comprises the following steps:

during a first pass, applying an ink with the aid of the ink jet printer (comprising print head 6 and UV lamp 7) to the glossy areas 3 of a first line without curing the glossy areas 3 of the first line immediately afterwards, during a second pass, applying an ink with the aid of the ink jet printer to the matt areas 2 of the first line and curing the matt areas 2 of the first line immediately afterwards, and the UV lamp 7 passes over and cures the glossy areas 3 of the first line during the second pass.

In FIGS. 5 to 9, it was assumed that the print head 6 and curing device 7 are coupled with one another. This can be achieved either by fixedly coupling the print head 6 and curing device 7 with one another or a coupling may be used to couple them with one another as and when necessary.

The curing device 7 may be disposed adjacent to the print head 6 for ink in a direction of movement of the print head, in which case they can be moved by a common drive (not illustrated in FIGS. 5 to 9) for the curing device 7 and print head 6. Alternatively, the curing device 7 may be coupled with the print head 6 for ink and they can be moved by a common drive.

FIG. 10 illustrates a situation in which the print head 6 is moved on its own but the UV lamp 7 remains in a parked position. Accordingly, in this operating mode, only images or image areas 3 with a glossy surface can be printed. If the UV lamp 7 is needed in order to print matt images or image areas 2 as well, the print head 6 moves alongside the UV lamp 7 where the two are coupled with one another by a coupling (not illustrated).

Alternatively, it would also be conceivable for the curing device 7 and print head 6 to be displaceable by separate drives. This situation is illustrated in FIG. 11. Across a specific distance, the UV lamp 7 moves after the print head 6, and it is assumed that the curing device 7 and print head 6 are moved at the same speed. The UV lamp 7 therefore starts to move slightly later.

By varying the distance between the print head 6 and curing device 7, the degree of gloss of the matt image areas 2 can be controlled. If the distance between the print head 6 and curing device 7 is large, the ink has more time to coalesce and thus form a relatively smooth surface. These areas do not appear completely matt, therefore, but also do not appear completely glossy, but tend towards glossy. If the distance between the print head 6 and curing device 7 is small, the ink has less time to coalesce and thus forms a relatively rough surface. Therefore, these areas likewise do not appear completely matt and do not appear completely glossy, but tend towards matt. In particular, it is possible to create transitions running between matt image areas 2 and glossy image areas 3 in this manner.

In the example described above, it was assumed that the print head 6 and curing device 7 are moved by separate drives. However, this is not absolutely necessary if creating half-matt and half-glossy image areas. As an alternative, it would be conceivable for the curing device 7 to be coupled with the print head 6 at a variable (local) distance. Again in this instance, the ink applied by the print head 6 is cured earlier or later. This distance could be adjusted by a printer controller or manually.

Another possible way of varying the degree of gloss in the image areas 2, 3 is to opt for a variable displacement speed of the print head 6 and curing device 7. Again, this means that the ink has more or less time to coalesce. The print head 6 and curing device 7 may be moved by a common drive or separate drives. It would also be conceivable for a distance between the print head 6 and curing device 7 as well as their displacement speed to be varied in order to cover a particularly broad range of the degree of gloss of the image areas.

FIG. 12 illustrates an ink jet printer 42 in which the print head 6 and curing device 7 constitute a joint component unit, which means that they can only be moved synchronously but also require only one common drive.

FIG. 13 illustrates another design of an ink jet printer 43, in which, instead of the UV lamp, a print head or spray head 9 for a curing medium is provided as the curing device. In this instance, the ink is cured with the aid of a curing medium which is sprayed on or applied during the ink jet printing operation. To this end, an ink is used, the drying process of which can be accelerated by a curing medium. The matt image areas 2 and glossy image areas 3 are created in the same way as the variant of the method described above. Instead of switching a UV lamp on and off, image areas are sprayed or not sprayed with a curing medium. As an alternative, it would also be conceivable to apply a substance which delays curing of the ink. In the same way as described above, this substance is applied to the glossy areas 3 but not to the matt areas 2.

FIG. 14 illustrates another variant of an ink jet printer 44, in which the curing device 3 is provided in the form of a UV lamp 7 with a diaphragm 10 connected downstream in the radiation direction. The UV lamp 7 can therefore be left permanently switched on, and the curing device 3 respectively the selective curing of image areas is activated by opening the diaphragm 10.

FIG. 14 also illustrates a control system 11 for the ink jet printer 44, which has an output for the curing device 3. Specifically, the diaphragm 10 is activated by the control system 11, i.e. activated (opened) in the matt areas and deactivated (closed) in the glossy areas. The control system 11 also has outputs for the print head 6 and a common drive 12.

Naturally, the control system 11 can be used not only for an ink jet printer 44 with a diaphragm 10 but also for the variants described above in connection with the previous drawings. In this respect, it should be pointed out that in order to activate the curing device 7, a positive logic could be just as easily used as a negative logic. In other words, activation of the curing device 7 may be associated with a positive logic level at the output of the control system 11 or with a negative logic level.

Finally, it should be pointed out that the longitudinal feeding action need not necessarily be effected by a bridge 8 which can be moved relative to a stationary substrate 5. As an equivalent, it would also be conceivable for the substrate 5 to be moved relative to the print head 6 which remains fixed and stationary in the longitudinal direction. The transverse and longitudinal directions of the substrate 5 are interchangeable, i.e. the substrate 5 may also be printed in landscape format. The substrates 5 might be any printable materials, in particular paper, films as well as fabrics, blueprints and similar. Although in the examples described above it was assumed that the matt image areas 2 and glossy image areas 3 are mutually exclusive, it would also be conceivable for said areas 2 and 3 to be mutually overlapping.

The embodiments illustrated as examples represent possible variants of the ink jet printer 40 . . . 44 and its control system 11 and operating method, and it should be pointed out at this stage that the invention is not specifically limited to the variants specifically illustrated, and instead the individual variants may be used in different combinations with one another and these possible variations lie within the reach of the person skilled in this technical field given the disclosed technical teaching. Accordingly, all conceivable variants which can be obtained by combining individual details of the variants described and illustrated are possible and fall within the scope of the invention.

In particular, it should be noted that in reality, ink jet printers 40 . . . 44 and their control systems 11 also comprise more components than are described here and/or may be based on a different design.

For the sake of good order, finally, it should be pointed out that, in order to provide a clearer understanding of the structure of the ink jet printer 40 . . . 44, it and its constituent parts are illustrated to a certain extent out of scale and/or on an enlarged scale and/or on a reduced scale.

The objective underlying the independent inventive solutions may be found in the description.

LIST OF REFERENCE NUMBERS

1 Image
2 Matt area
3 Glossy area
40 . . . 44 Ink jet printer
5 Substrate
6 Print head for ink
7 Curing device (UV lamp)
8 Bridge
9 Curing device (spray head)
10 Diaphragm
11 Control system
12 Drive motor

The invention claimed is:

1. Method of printing an image (1) having matte areas (2) and glossy areas (3), comprising the steps during a first pass, applying an ink with the aid of an ink jet printer having a print head (6) and curing device (7, 9) to the glossy areas (3) of a first line without curing the glossy areas (3) of the first line immediately afterwards, during a second pass, applying an ink with the aid of the ink jet printer to the matte areas (2) of the first line and curing the matte areas (2) of the first line immediately afterwards, wherein the curing device (7, 9) passes over and cures the glossy areas (3) of the first line during the second pass.

2. Method of printing an image (1) having matte areas (2) and glossy areas (3), comprising the steps, applying an ink with the aid of an ink jet printer having a print head (6) and curing device (7, 9) to the matte areas (2) of a first line and curing the matte areas (2) of the first line immediately afterwards, applying an ink with the aid of the ink jet printer to the glossy areas (3) of the first line without curing the glossy areas (3) of the first line immediately afterwards, applying an ink with the aid of the ink jet printer to the matte areas (2) of a second line following the first line and curing the matte areas (2) of the second line immediately afterwards, wherein the glossy areas (3) of the first line are cured at the same time as the matte areas of the second line are being cured.

3. Method according to claim 1, wherein the curing device (7, 9) is moved after the print head (6).

4. Method according to claim 1, wherein the matte areas (2) are printed in one direction of movement of the print head (6) and the glossy areas (3) are printed in the other direction of movement of the print head (6).

5. Method according to claim 1, wherein curing is effected with the aid of a UV lamp (7).

6. Method according to claim 5, wherein curing is effected by activating the UV lamp (7).

7. Method according to claim 5, wherein curing is effected by opening a diaphragm (10) connected downstream of the UV lamp (7) in the radiation direction.

8. Method according to claim 1, wherein curing is effected with the aid of a curing medium sprayed on or applied with the aid of the ink jet printer.

9. Method according to claim 1, wherein a displacement speed of the print head (6) and curing device (7, 9) is variable.

10. Method according to claim 1, wherein a distance between the print head (6) and curing device (7, 9) is variable.

11. Control system for an ink jet printer (40 . . . 44) for printing an image (1) having glossy areas (3) and matte areas (2), comprising an output for a curing device (7, 9) which, during operation of the ink jet printer (40 . . . 44), is activated in the matte areas (2) and deactivated in the glossy areas (3) immediately after applying the ink, and the control system is also configured to activate the curing device (7, 9) so that the glossy areas (3) are cured at the same time as the matte areas are being cured.

12. Ink jet printer (40 . . . 44), comprising a print head (6) for ink, comprising a curing device (7, 9) which is connected to a control system (11) according to claim 11.

13. Ink jet printer (40 . . . 44) according to claim 12, wherein the curing device (7, 9) is disposed adjacent to the print head (6) for ink in a direction of movement of the print head (6) and the latter can be moved by a common drive (12) for the curing device (7, 9) and print head (6).

14. Ink jet printer (40 . . . 44) according to claim 12, wherein the curing device (7, 9) can be coupled with the print head (6) for ink and the latter can be moved by a common drive (12) for the curing device (7, 9) and print head (6).

15. Ink jet printer (40 . . . 44) according to claim 12, wherein the curing device (7, 9) and the print head (6) for ink can be moved by separate drives.

16. Ink jet printer (40 . . . 44) according to claim 12, wherein the curing device is provided in the form of a UV lamp (7), the latter being activated by switching it on.

17. Ink jet printer (40 . . . 44) according to claim 12, wherein the curing device is provided in the form of a UV lamp (7) with a diaphragm (10) connected downstream in the radiation direction and activation is effected by opening the diaphragm (10).

18. Ink jet printer (40 . . . 44) according to claim 12, wherein the curing device is provided in the form of a print head or spray head (9) for a curing medium and activation is effected by applying same.

* * * * *